US007923632B2

(12) United States Patent
Smith et al.

(10) Patent No.: US 7,923,632 B2
(45) Date of Patent: Apr. 12, 2011

(54) COMMUNICATION CABLE COMPRISING ELECTRICALLY DISCONTINUOUS SHIELD HAVING NONMETALLIC APPEARANCE

(75) Inventors: Delton C. Smith, Kennesaw, GA (US); James S. Tyler, Woodstock, GA (US); Christopher McNutt, Woodstock, GA (US); Paul E. Neveux, Jr., Atlanta, GA (US)

(73) Assignee: Superior Essex Communications LP, Atlanta, GA (US)

( * ) Notice: Subject to any disclaimer, the term of this patent is extended or adjusted under 35 U.S.C. 154(b) by 191 days.

(21) Appl. No.: 12/313,910

(22) Filed: Nov. 25, 2008

(65) Prior Publication Data

US 2009/0200060 A1 Aug. 13, 2009

Related U.S. Application Data

(63) Continuation-in-part of application No. 11/502,777, filed on Aug. 11, 2006, now abandoned.

(51) Int. Cl.
*H01B 11/06* (2006.01)

(52) U.S. Cl. ..... 174/36; 174/112

(58) Field of Classification Search ..... 174/36, 174/112

See application file for complete search history.

(56) References Cited

U.S. PATENT DOCUMENTS

| | | | | | |
|---|---|---|---|---|---|
| 2,796,463 | A | * | 6/1957 | Mallinckrodt | 178/45 |
| 3,090,825 | A | * | 5/1963 | Volk | 174/109 |
| 3,312,774 | A | * | 4/1967 | Drinko et al. | 174/120 SC |
| 4,746,767 | A | * | 5/1988 | Gruhn | 174/36 |
| 5,008,489 | A | * | 4/1991 | Weeks et al. | 174/36 |
| 2006/0048961 | A1 | * | 3/2006 | Pfeiler et al. | 174/36 |

* cited by examiner

*Primary Examiner* — Chau N Nguyen
(74) *Attorney, Agent, or Firm* — King & Spalding LLP

(57) ABSTRACT

A tape can comprise a dielectric film that has a pattern of electrically conductive areas adhering thereto. The conductive areas can be electrically isolated from one another. The tape can utilize means to obscure the metallic finish and can contain indicators to deter installers from grounding the tape at either end. The tape can be wrapped around one or more conductors, such as wires that transmit data, to provide electrical or electromagnetic shielding for the conductors. The resulting cable can have a shield that is electrically discontinuous between opposite ends of the cable.

16 Claims, 5 Drawing Sheets

COMMUNICATION CABLE COMPRISING ELECTRICALLY DISCONTINUOUS SHIELD HAVING NONMETALLIC APPEARANCE

CROSS REFERENCE TO RELATED APPLICATIONS

This application is a continuation in part of and claims priority to U.S. patent application Ser. No. 11/502,777, now abandoned entitled "Method And Apparatus For Fabricating Noise-Mitigating Cable" and filed on Aug. 11, 2006 in the name of Delton C. Smith et al., the entire contents of which are hereby incorporated herein by reference.

This application is related to the co-assigned U.S. patent application entitled "Communication Cable Comprising Electrically Isolated Patches of Shielding Material" filed concurrently herewith and assigned U.S. patent application Ser. No. 12/313,914, the entire contents of which are hereby incorporate herein by reference.

FIELD OF THE TECHNOLOGY

The present invention relates to manufacturing a communication cable that is shielded from electromagnetic radiation and more specifically to applying isolated patches of conductive material to a dielectric film, providing the film with a nonmetallic appearance, and wrapping the resulting material around wires of the cable.

BACKGROUND

As the desire for enhanced communication bandwidth escalates, transmission media need to convey information at higher speeds while maintaining signal fidelity and avoiding crosstalk. However, effects such as noise, interference, crosstalk, alien crosstalk, and alien elfext crosstalk can strengthen with increased data rates, thereby degrading signal quality or integrity. For example, when two cables are disposed adjacent one another, data transmission in one cable can induce signal problems in the other cable via crosstalk interference.

One approach to addressing crosstalk in a communication cable is to circumferentially encase the cable in a continuous shield, such as a flexible metallic tube or a foil that coaxially surrounds the cable's conductors. However, shielding based on convention technology can be expensive to manufacture and/or cumbersome to install in the field. In particular, complications can arise when a cable is encased by a shield that is electrically continuous between the two ends of the cable.

In a typical application, each cable end is connected to a terminal device such as an electrical transmitter, receiver, or transceiver. The continuous shield can inadvertently carry voltage along the cable, for example from one terminal device at one end of the cable towards the other terminal device at the other end of the cable. If a person contacts the shielding, the person may receive a shock if the shielding is not properly grounded. Accordingly, continuous cable shields are typically grounded at both ends of the cable to reduce shock hazards and loop currents that can interfere with transmitted signals.

Such a continuous shield can also set up standing waves of electromagnetic energy based on signals received from nearby energy sources. In this scenario, the shield's standing wave can radiate electromagnetic energy, somewhat like an antenna, that may interfere with wireless communication devices or other sensitive equipment operating nearby.

Accordingly, to address these representative deficiencies in the art, what is needed is an improved capability for shielding conductors that may carry high-speed communication signals. Another need exists for a method and apparatus for efficiently manufacturing communication cables that are resistant to noise. Yet another need exists for a cable construction that effectively suppresses crosstalk and/or other interference without providing an electrically conductive path between ends of the cable. A further need exists for imparting a discontinuous shield with a nonmetallic appearance or an indication that the shield functions without grounding. A capability addressing one or more of these needs would support increasing bandwidth without unduly increasing cost or installation complexity.

SUMMARY

The present invention supports fabricating, manufacturing, or making shielded cables that may be used to communicate data or other information.

In one aspect of the present invention, a section of dielectric film can have a pattern of electrically conductive areas or patches attached thereto, wherein the conductive areas are electrically isolated from one another. The section of dielectric film can comprise a tape, a ribbon, or a narrow strip of dielectric material, such as polyester, polypropylene or some other non-conducting polymer. The conductive areas can comprise aluminum, copper, metallic material, or some other form of material that readily conducts electricity. The conductive areas can be printed, fused, transferred, bonded, vapor deposited, imprinted, coated, or otherwise attached to the dielectric film. In other words, a tape can comprise a flexible dielectric material having conductive patches attached thereto, and physical separation between the conductive patches can electrically isolate the patches from one another. The tape can provide visual information for differentiating the tape from a continuous, metallic tape that would ordinarily be grounded in installation. For example, the tape can comprise a colorant or other agent on the conductive patches and/or on the dielectric film to obscure any metallic finish or metallic appearance of the patches. As another example, the tape can comprise a plurality of strips of opaque dielectric film that enclose the conductive patches. As another example, the tape can comprise a message or notification in one or more locations along the tape informing a user that the cable can be deployed without electrically grounding the tape.

The tape can be wrapped around one or more conductors, such as wires that transmit data, to provide electrical or electromagnetic shielding for the conductors. The tape can also be wrapped around the cable itself, alone or enveloped by another jacket. The tape and/or the resulting shield can be electrically discontinuous between opposite ends of the cable. Thus, incremental sections or segments of conductive shielding can circumscribe the cable at incremental locations along the cable. While electricity can flow freely in each individual section of shielding, the shield discontinuities can inhibit electricity from flowing in the shielding material along the full or axial length of the cable.

The discussion of shielding conductors presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

BRIEF DESCRIPTION OF THE DRAWINGS

FIG. 3, are a flowchart depicting an exemplary process for manufacturing shielded cable in accordance with an embodiment of the present invention.

Figure 1:
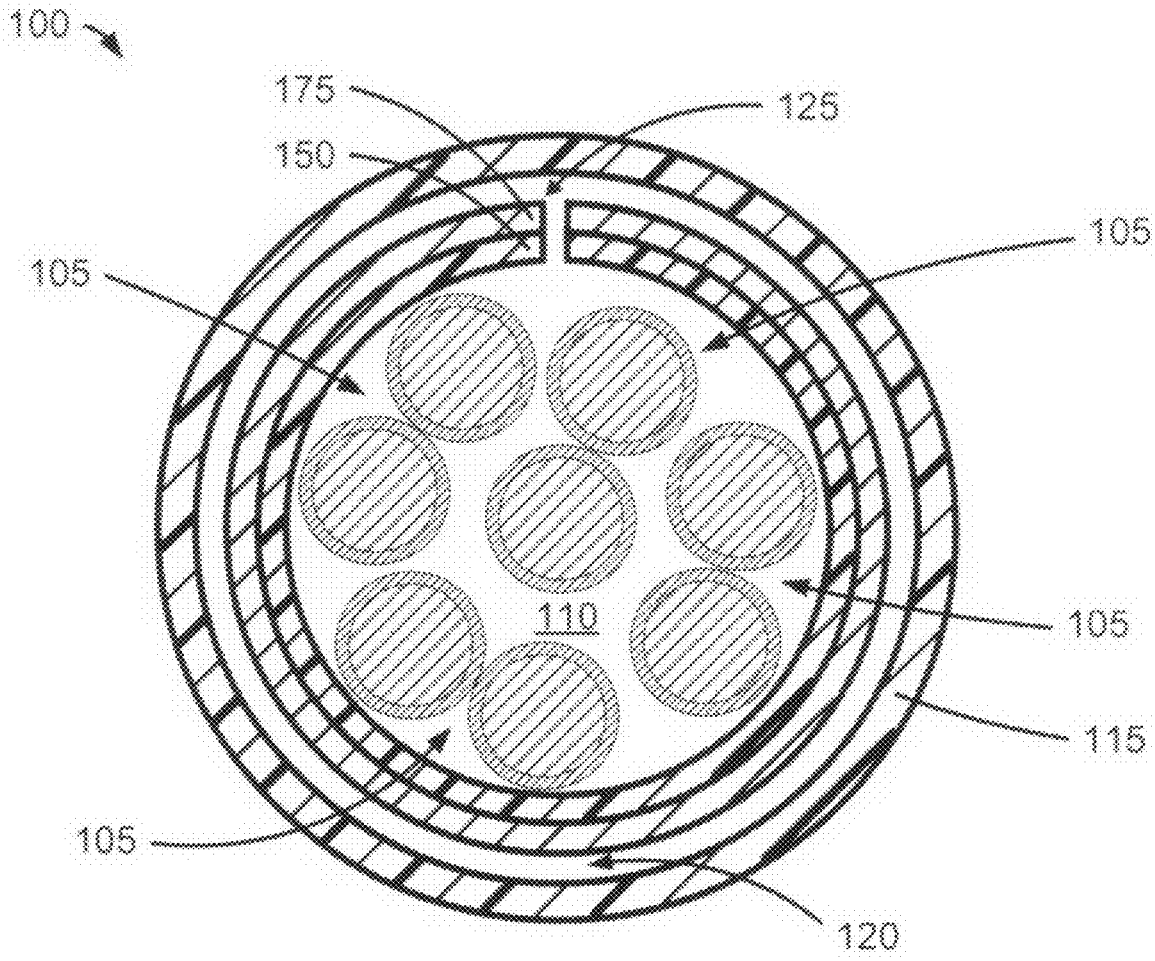
FIG. 1 is a cross sectional view of an exemplary communication cable that comprises a segmented shield in accordance with an embodiment of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimension may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The present invention supports manufacturing or fabricating a noise-mitigating communication cable, wherein at least one break or discontinuity in the shielding along the cable electrically isolates the shielding at one end of the cable from the shielding at the other end of the cable. As an alternative to forming a continuous or contiguous conductive path, the tape can be segmented or can comprise intermittently conductive patches or areas.

Figure 2A:
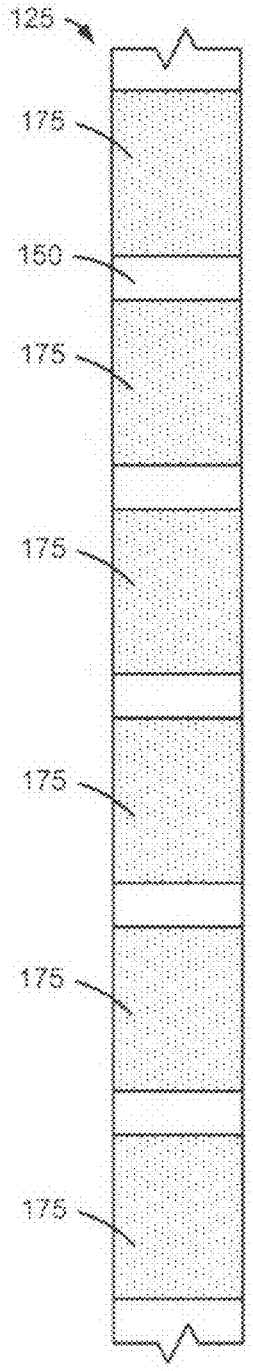
FIGS. 2A and 2B are, respectively, overhead and cross sectional views of an exemplary segmented tape that comprises a pattern of conductive patches attached to a dielectric film substrate in accordance with an embodiment of the present invention.
Figure 2B:
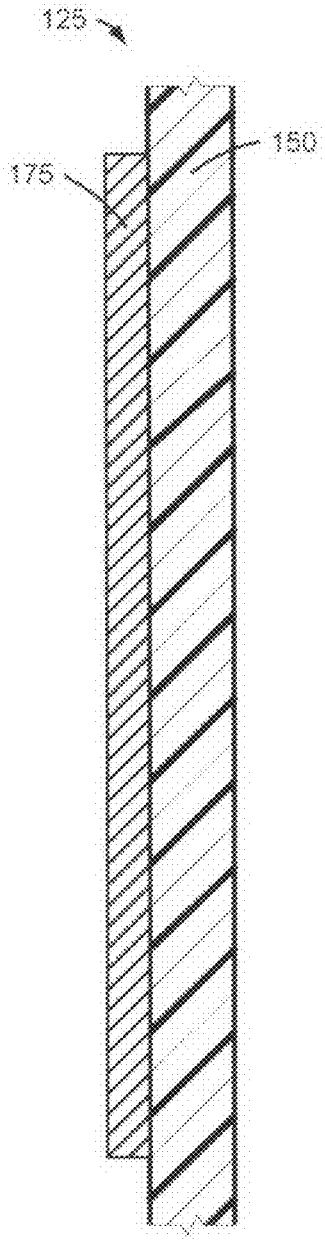
Figure 2C:
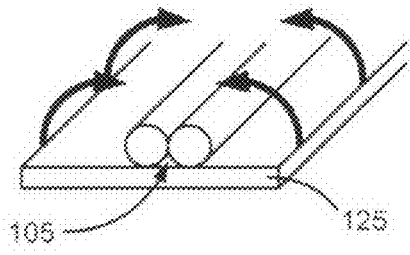
FIG. 2C is an illustration of an exemplary technique for wrapping a segmented tape lengthwise around a pair of conductors in accordance with an embodiment of the present invention.
Figure 3A:
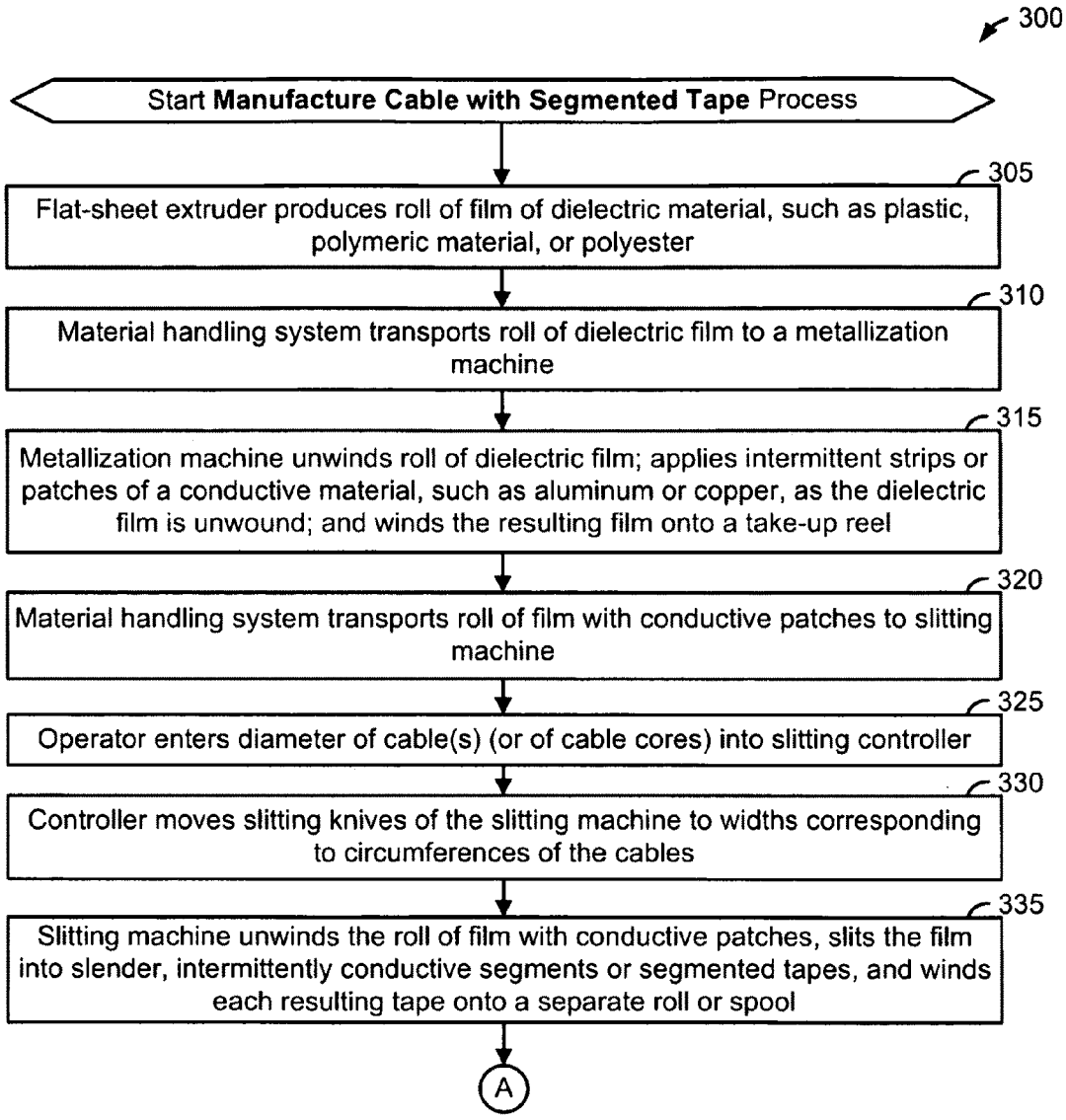
FIGS. 3A and 3B, collectively
Figure 3B:
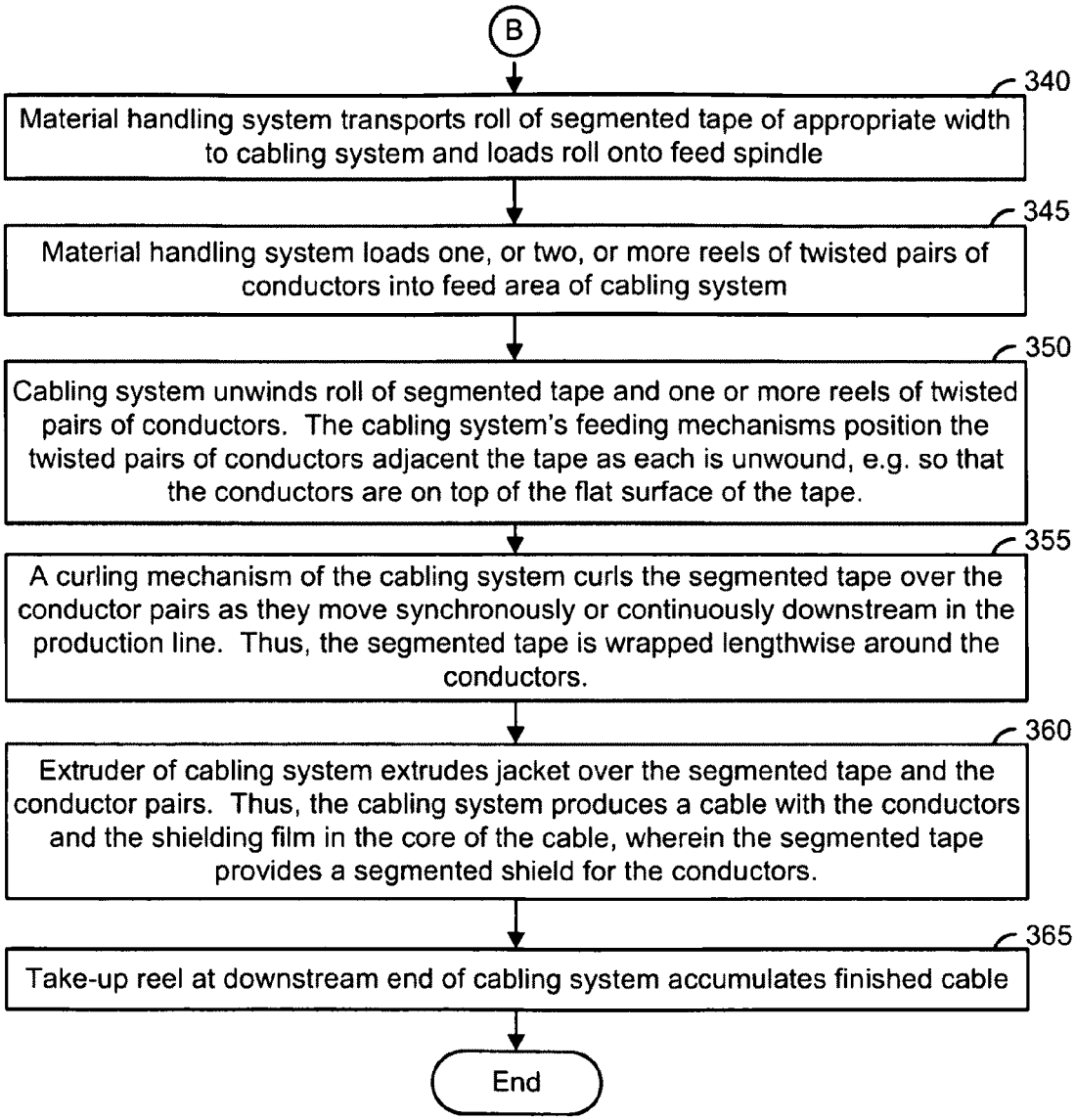
Figure 4A:
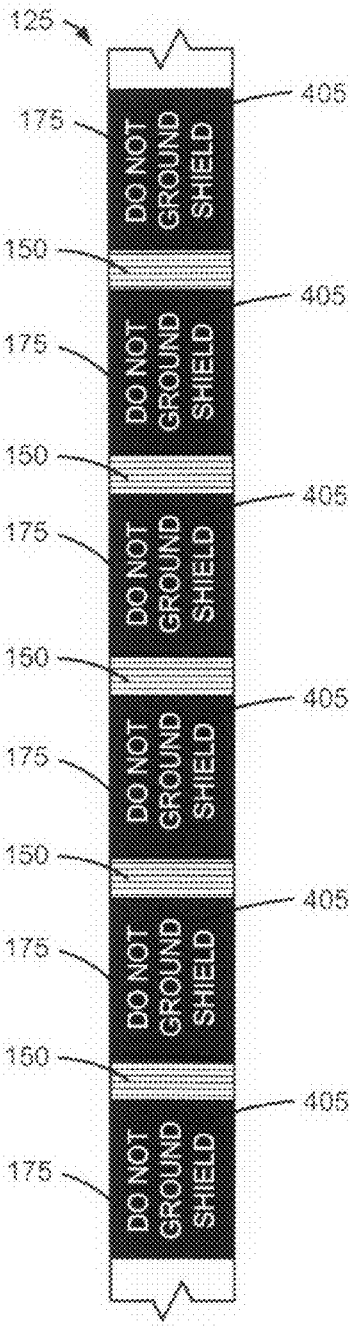
FIGS. 4A and 4B are, respectively, overhead and cross sectional views of exemplary segmented tapes that comprise patterns of conductive patches attached to a dielectric film substrate and technology for differentiating the segmented tape from a continuous, metallic tape in accordance with an embodiment of the present invention.
Figure 4B:
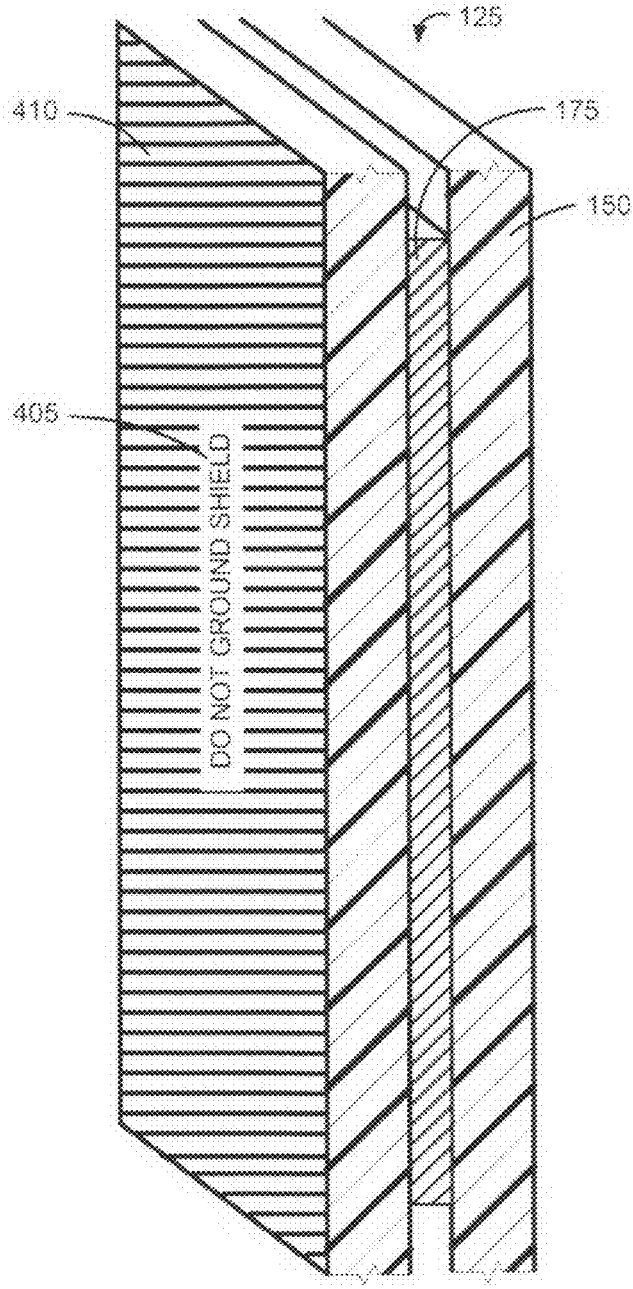

A method and apparatus for making cables comprising a segmented tape will now be described more fully hereinafter with reference to FIGS. 1-4, which describe representative embodiments of the present invention. In an exemplary embodiment, the segmented tape can be characterized as shielding tape or as tape with segments or patches of conductive material. FIG. 1 provides an end-on view of a cable with segmented tape. FIGS. 2A and 2B show a tape that can be used for fabricating a cable with segmented tape. FIG. 2C depicts wrapping segmented tape around or over conductors. FIG. 3 offers a process for making cable with segmented shielding. FIGS. 4A and 4B (collectively FIG. 4) show tapes with an obscured metallic finish that can be used for fabricating a cable with segmented tape.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Turning now to FIG. 1, this figure illustrates a cross sectional view of a communication cable 100 that comprises a segmented shield 125 according to an exemplary embodiment of the present invention.

The core 110 of the cable 100 contains four pairs of conductors 105, four being an exemplary rather than limiting number. Each pair 105 can be a twisted pair that carries data at 10 Gbps, for example. The pairs 105 can each have the same twist rate (twists-per-meter or twists-per-foot) or may be twisted at different rates.

The core 110 can be hollow as illustrated or alternatively can comprise a gelatinous, solid, or foam material, for example in the interstitial spaces between the individual conductors 105. In one exemplary embodiment, one or more members can separate each of the conductor pairs 105 from the other conductor pairs 105. For example, the core 110 can contain an extruded or pultruded separator that extends along the cable 110 and that provides a dedicated cavity or channel for each of the four conductor pairs 105. Viewed end-on or in cross section, the separator could have a cross-shaped geometry or an x-shaped geometry.

Such an internal separator can increase physical separation between each conductor pair 105 and can help maintain a random orientation of each pair 105 relative to the other pairs 105 when the cable 100 is field deployed.

A segmented tape 125 surrounds and shields the four conductor pairs 105. As discussed in further detail below, the segmented tape 125 comprises a substrate film 150 with patches 175 of conductive material attached thereto. As illustrated, the segmented tape 125 extends longitudinally along the length of the cable 100, essentially running parallel with and wrapping over the conductors 105.

In an alternative embodiment, the segmented tape 125 can wind helically or spirally around the conductor pairs 105. More generally, the segmented tape 125 can circumferentially cover, house, encase, or enclose the conductor pairs 105. Thus, the segmented tape 125 can circumscribe the conductors 105, to extend around or over the conductors 105. Although FIG. 1 depicts the segmented tape 125 as partially circumscribing the conductors 105, that illustrated geometry is merely one example. In many situations, improved blockage of radiation will result from overlapping the segmented tape 125 around the conductors 105, so that the segmented tape fully circumscribes the conductors 105. Moreover, in certain embodiments, the side edges of the segmented tape 125 can essentially butt up to one another around the core 110 of the cable 100. Further, in certain embodiments, a significant gap can separate these edges, so that the segmented tape 125 does not fully circumscribe the core 110.

In one exemplary embodiment, one side edge of the segmented tape 125 is disposed over the other side edge of the tape 125. In other words, the edges can overlap one another, with one edge being slightly closer to the center of the core 110 than the other edge.

An outer jacket 115 of polymer seals the cable 110 from the environment and provides strength and structural support. The jacket 115 can be characterized as an outer sheath, a jacket, a casing, or a shell. A small annular spacing 120 may separate the jacket 115 from the segmented tape 125.

In one exemplary embodiment, the cable 100 or some other similarly noise mitigated cable can meet a transmission requirement for "10 G Base-T data corn cables." In one exemplary embodiment, the cable 100 or some other similarly noise mitigated cable can meet the requirements set forth for 10 Gbps transmission in the industry specification known as TIA 568-B.2-10 and/or the industry specification known as ISO 11801. Accordingly, the noise mitigation that the segmented tape 125 provides can help one or more twisted pairs of conductors 105 transmit data at 10 Gbps or faster without unduly experiencing bit errors or other transmission impairments. As discussed in further detail below, an automated and scalable process can fabricate the cable 100 using the segmented tape 125.

Turning now to FIGS. 2A and 2B, these figures respectively illustrate overhead and cross sectional views of a segmented tape 125 that comprises a pattern of conductive patches 175 attached to a substrate film 150 according to an exemplary embodiment of the present invention. That is, FIGS. 2A and 2B depict an exemplary embodiment of the segmented tape 125 shown in FIG. 1 and discussed above. More specifically, FIG. 1 illustrates a cross sectional view of the cable 100 wherein the cross section cuts through one of the conductive patches 175, perpendicular to the major axis of the segmented tape 125.

The segmented tape 125 comprises a substrate film 150 of flexible dielectric material that can be wound around and stored on a spool. That is, the illustrated section of segmented tape 125 can be part of a spool of segmented tape 125. The film can comprise a polyester, polypropylene, polyethylene, polyimide, or some other polymer or dielectric material that does not ordinarily conduct electricity. That is, the segmented tape 125 can comprise a thin strip of pliable material that has at least some capability for electrical insulation. In one exemplary embodiment, the pliable material can comprise a membrane or a deformable sheet. In one exemplary embodiment, the substrate is formed of the polyester material sold by E. I. DuPont de Nemours and Company under the registered trademark MYLAR.

The conductive patches 175 can comprise aluminum, copper, nickel, iron, or some metallic alloy or combination of materials that readily transmits electricity. The individual patches 175 can be separated from one another so that each patch 175 is electrically isolated from the other patches 175. That is, the respective physical separations between the patches 175 can impede the flow of electricity between adjacent patches 175.

The conductive patches 175 can span fully across the segmented tape 125, between the tape's long edges. As discussed in further detail below, the conductive patches 175 can be attached to the substrate film 150 via gluing, bonding, adhesion, printing, painting, welding, coating, heated fusion, melting, or vapor deposition, to name a few examples.

In one exemplary embodiment, the conductive patches 175 can be over-coated with an electrically insulating film, such as a polyester coating (not shown in FIGS. 2A and 2B). In one exemplary embodiment, the conductive patches 175 are sandwiched between two dielectric films, the substrate film 150 and another electrically insulating film (shown in FIG. 4B and discussed below).

The segmented tape 125 can have a width that corresponds to the circumference of the core 110 of the cable 100. The width can be slightly smaller than, essentially equal to, or larger than the core circumference, depending on whether the longitudinal edges of the segmented tape 125 are to be separated, butted together, or overlapping, with respect to one another in the cable 100.

In one exemplary embodiment, the substrate film 150 has a thickness of about 1-5 mils (thousandths of an inch) or about 25-125 microns. Each conductive patch 175 can comprise a coating of aluminum having a thickness of about 0.5 mils or about 13 microns. Each patch 175 can have a length of about 1.5 to 2 inches or about 4 to 5 centimeters. Other exemplary embodiments can have dimensions following any of these ranges, or some other values as may be useful. The dimensions can be selected to provide electromagnetic shielding over a specific band of electromagnetic frequencies or above or below a designated frequency threshold, for example.

Turning now to FIG. 2C, this figure illustrates wrapping a segmented tape 125 lengthwise around a pair of conductors 105 according to an exemplary embodiment of the present invention. Thus, FIG. 2C shows how the segmented tape 125 discussed above can be wrapped around or over one or more pairs of conductors 125 as an intermediate step in forming a cable 100 as depicted in FIG. 1 and discussed above. While FIG. 1 depicts four pairs of wrapped conductors 105, FIG. 2C illustrates wrapping a single pair 105 as an aid to visualizing an exemplary assembly technique.

As illustrated in FIG. 2C, the pair of conductors 105 is disposed adjacent the segmented tape 125. The conductors 105 extend essentially parallel with the major or longitudinal axis/dimension of the segmented tape 125. Thus, the conductors 105 can be viewed as being parallel to the surface or plane of the segmented tape 125. Alternatively, the conductors 105 can be viewed as being over or under the segmented tape 125 or being situated along the center axis of the segmented tape 125. Moreover, the conductors 105 can be viewed as being essentially parallel to one or both edges of the segmented tape 125.

The long edges of the segmented tape 125 are brought up over the conductors 105, thereby encasing the conductors 105 or wrapping the segmented tape 125 around or over the conductors 105. In an exemplary embodiment, the motion can be characterized as folding or curling the segmented tape 125 over the conductors 105. As discussed above, the long edges of the segmented tape 125 can overlap one another following the illustrated motion.

In one exemplary embodiment, the conductive patches 175 face inward, towards the conductors 105. In another exemplary embodiment, the conductive patches 175 face away from the conductors 105, towards the exterior of the cable 100.

In one exemplary embodiment, the segmented tape 125 and the conductors 105 are continuously fed from reels, bins, containers, or other bulk storage facilities into a narrowing chute or a funnel that curls the segmented tape 125 over the conductors 105.

In one exemplary embodiment, FIG. 2C describes operations in a zone of a cabling machine, wherein segmented tape 125 fed from one reel (not illustrated) is brought into contact with conductors 105 feeding off of another reel. That is, the segmented tape 125 and the pair of conductors 105 can synchronously and/or continuously feed into a chute or a mechanism that brings the segmented tape 125 and the conductors 105 together and that curls the segmented tape 125 lengthwise around the conductors 105. So disposed, the segmented tape 125 encircles or encases the conductors 105 in discontinuous, conductive patches.

Downstream from this mechanism (or as a component of this mechanism), a nozzle or outlet port can extrude a polymeric jacket, skin, casing, or sheath 115 over the segmented tape, thus providing the basic architecture depicted in FIG. 1 and discussed above.

Turning now to FIG. 3, this figure is a flowchart depicting a process 300 for manufacturing shielded cable 100 according to an exemplary embodiment of the present invention. Process 300 can produce the cable 100 illustrated in FIG. 1 using the segmented tape 125 and the conductors 105 as base materials.

At Step 305 an extruder produces a film of dielectric material, such as polyester, which is wound onto a roll or a reel. At this stage, the film can be much wider than the circumference of any particular cable in which it may ultimately be used and might one to three meters across, for example. As discussed in further detail below, the extruded film will be processed to provide the substrate film 150 discussed above.

In one exemplary embodiment, the extruder can apply a colorant, an opacity promoter, or an obscuring agent to the dielectric material before it is wound onto a roll or a reel. Such additives can impart the segmented tape 125 with a visual appearance that a user can clearly distinguish from a continuous, metallic tape that the user would be inclined to attach to a grounding post or rod.

At Step 310, a material handling system transports the roll to a metallization machine or to a metallization station. The material handling system can be manual, for example based on one or more human operated forklifts or may alternatively be automated, thereby requiring minimal, little, or essentially no human intervention during routine operation. The material handling may also be tandemized with a film producing station. Material handing can also comprise transporting materials between production facilities or between vendors or independent companies, for example via a supplier relationship.

At Step 315, the metallization machine unwinds the roll of dielectric film and applies a pattern of conductive patches to the film. The patches typically comprise strips that extend across the roll, perpendicular to the flow of the film off of the roll. The patches are typically formed while the sheet of film is moving from a take-off roll (or reel) to a take-up roll (or reel). As discussed in further detail below, the resulting material will be further processed to provide multiple of the segmented tapes 125 discussed above.

In one exemplary embodiment, the metallization machine can apply the conductive patches to the dielectric film by coating the moving sheet of dielectric film with ink or paint comprising metal. In one exemplary embodiment, the metallization machine can laminate segments of metallic film onto the dielectric film. Heat, pressure, radiation, adhesive, or a combination thereof can laminate the metallic film to the dielectric film.

In one exemplary embodiment, the metallization machine cuts a feed of pressure-sensitive metallic tape into appropriately sized segments. Each cut segment is placed onto the moving dielectric film and is bonded thereto with pressure, thus forming a pattern of conductive strips across the dielectric film.

In one exemplary embodiment, the metallization machine creates conductive areas on the dielectric film using vacuum deposition, electrostatic printing, or some other metallization process known in the art.

In one exemplary embodiment, Process 300 can include a step for sandwiching the conductive patches 175 between two layers of substrate film 150, 410 as illustrated in FIG. 4 and discussed below. For example, step 315 can comprise applying the substrate film 410 over the conductive patches 175. After the metallization machine has attached the patches of conductive material to the substrate film 150, a machine can attach the substrate film 410 to the substrate film 150.

At Step 320, the material handling system transports the roll of film, which comprises a pattern of conductive areas or patches at this stage, to a slitting machine. At Step 325, an operator, or a supervisory computer-based controller, of the slitting machine enters a diameter of the core 110 of the cable 100 that is to be manufactured.

At Step 330, the slitting machine responds to the entry and moves its slitting blades or knives to a width corresponding to the circumference of the core 110 of the cable 100. As discussed above, the slitting width can be slightly less than the circumference, thus producing a gap around the conductor(s) or slightly larger than the circumference to facilitate overlapping the edges of the segmented tape 125 in the cable 100.

At Step 335, the slitting machine unwinds the roll and passes the sheet through the slitting blades, thereby slitting the wide sheet into narrow strips, ribbons, or tapes 125 that have widths corresponding to the circumferences of one or more cables 100. The slitting machine winds each tape 125 unto a separate roll, reel, or spool, thereby producing the segmented tape 125 as a roll or in some other bulk form.

While the illustrated embodiment of Process 300 creates conductive patches on a wide piece of film and then slits the resulting material into individual segmented tapes 125, that sequence is merely one possibility. Alternatively, a wide roll of dielectric film can be slit into strips of appropriate width that are wound onto individual rolls. A metallization machine can then apply conductive patches 175 to each narrow-width roll, thereby producing the segmented tape 125. Moreover, a cable manufacturer might purchase pre-sized rolls of the substrate film 150 and then apply the conductive patches 175 thereto to create corresponding rolls of the segmented tape 125. In an exemplary embodiment, the substrate film 410 is applied over the conductive patches 175 as illustrated in FIG. 4.

At Step 340, the material handling system transports the roll of sized segmented tape 125, which comprises the conductive patches 175 or some form of isolated segments of electrically conductive material, to a cabling system. The material handling system loads the roll of the segmented tape 125 into the cabling system's feed area, typically on a designated spindle. The feed area is typically a facility where the cabling machine receives bulk feedstock materials, such as segmented tape 125 and conductors 105.

At Step 345, the material handling system loads rolls, reels, or spools of conductive wires 105 onto designated spindles at the cabling system's feed area. To produce the cable 100 depicted in FIG. 1 as discussed above, the cabling system would typically use four reels, each holding one of the four pairs of conductors 105.

At Step 350, the cabling system unwinds the roll of the segmented tape 125 and, in a coordinated or synchronous fashion, unwinds the pairs of conductors 105. Thus, the segmented tape 125 and the conductors 105 feed together as they move through the cabling system.

A tapered feed chute or a funneling device places the conductors 105 adjacent the segmented tape 125, for example as illustrated in FIG. 2C and discussed above. The cabling system typically performs this material placement on the moving conductors 105 and segmented tape 125, without necessarily requiring either the conductors 105 or the segmented tape 125 to stop. In other words, tape-to-conductor alignment occurs on a moving steam of materials.

At Step 355, a curling mechanism wraps the segmented tape 125 around the conductors 105, typically as shown in FIG. 2C and as discussed above, thereby forming the core 110 of the cable 100. The curling mechanism can comprise a tapered chute, a narrowing or curved channel, a horn, or a contoured surface that deforms the segmented tape 125 over the conductors 105, typically so that the long edges of the segmented tape 125 overlap one another.

At Step 360, an extruder of the cabling system extrudes the polymer jacket 115 over the segmented tape 125 (and the conductors 105 wrapped therein), thereby forming the cable 100. Extrusion typically occurs downstream from the curling mechanism or in close proximity thereof. Accordingly, the jacket 115 typically forms as the segmented tape 125, the conductors 105, and the core 110 move continuously downstream through the cabling system.

At Step 365, a take-up reel at the downstream side of the cabling system winds up the finished cable 100 in preparation for field deployment. Following Step 365, Process 300 ends and the cable 100 is completed. Accordingly, Process 300 provides an exemplary method for fabricating a cable comprising an electrically discontinuous shield that protects against electromagnetic interference and that supports high-speed communication.

Turning now to FIG. 4A, this figure illustrates an overhead view of a segmented tape 125 that comprises a pattern of conductive patches 175 attached to a substrate film 150 and information differentiating the segmented tape 125 from a continuous, metallic tape according to an exemplary embodiment of the present invention. That is, FIG. 4A depicts an exemplary embodiment of the segmented tape 125 shown in FIG. 1 and discussed above, wherein the segmented tape 125 includes a message to the user about grounding.

The substrate film 150 and conductive patches 175 can comprise a colorant, with either the substrate film 150 and conductive patches 175 having the same color or differing colors. The substrate film 150 and conductive patches 175 can comprise a colorant of one solid color, a plurality of colors or a pattern of colors. The material used as the colorant for the substrate film 150 or conductive patches 175 can comprise paint, die, and anodize. With such coloring, the segmented tape 125 is visibly distinguishable from a metallic tape that a user would be inclined to ground. Thus, the tape can comprise a nonmetallic finish or an appearance that is nonmetallic.

The segmented tape 125 can have grounding indicators 405 on the outside surface to inform installers about grounding the ends of the segmented tape 125. For example, the grounding indicator can be text that reads "Do Not Ground Shield." The grounding indicator 405 can be on both the substrate film 150 and the conductive patches 175, or on either one of the substrate film 150 or the conductive patches 175. The grounding indicator 405 can be displayed a plurality of times along the segmented tape 125 with specific distances between each instance of the grounding indicator 405.

In one exemplary embodiment, the substrate film 150 can comprise a solid blue colorant and the conductive patches 175 can comprise a solid black colorant. In one exemplary embodiment, the segmented tape 125 can have a grounding indicator 405 of text, "Do Not Ground Shield", printed in white on the outside of the segmented tape 125 with such text being printed on both the substrate film 150 and conductive patches 175, and with such text displayed in each two-inch portion of the segmented tape 125.

Turning now to FIG. 4B, this figure illustrates a cross sectional view of a segmented tape 125 that comprises a pattern of conductive patches 175 attached to substrate film 150 wherein substrate film 410 adheres to the segmented tape 125 and the conductive patches of segmented tape 125 are sandwiched between substrate film 150 and substrate film 410 according to exemplary embodiments of the present invention.

The substrate film 410 can comprise a polyester, polypropylene, polyethylene, polyimide, or some other flexible polymer or dielectric material that does not ordinarily conduct electricity and that can be wound around and stored on a spool. That is, the substrate film 410 can comprise a thin strip of pliable material that has at least some capability for electrical insulation. In one exemplary embodiment, the pliable material can comprise a membrane or a deformable sheet. In one exemplary embodiment, the substrate is formed of the polyester material sold by E. I. DuPont de Nemours and Company under the registered trademark MYLAR.

In one exemplary embodiment, the substrate film 410 has a thickness of about 1-5 mils (thousandths of an inch) or about 25-125 microns. Other exemplary embodiments can have dimensions following any of these ranges, or some other values as may be useful as discussed above.

A single strip of substrate film 410 can span the entire length of segmented tape 125 or a plurality of substrate films 410 can be attached to segmented tape 125. As discussed in further detail below, each strip of substrate film can be attached to the segmented tape 125 by way of gluing, bonding, adhesion, printing, painting, welding, coating, heated fusion, melting, or vapor deposition, to name a few examples.

In one exemplary embodiment, the segmented tape 125 can comprise a substrate film 410 that covers the conductive patches 175 that adhere to substrate film 150. In one exemplary embodiment, substrate film 410 and substrate film 150 can comprise a blue colorant. In one exemplary embodiment, the substrate film can have a grounding indicator 405 of text, "Do Not Ground Shield", printed in white on the outside of substrate film 410. The substrate film 150 and the substrate film 410 can be opaque or colored so as to provide the segmented tape 125 with a nonmetallic finish. Thus, the conductive patches 175 can comprise metal that is embedded and/or covered by opaque, colored, or dark material so as to obscure a metallic finish. Moreover, the segmented tape 125 can comprise a finish that is dull, non-reflective, or colored.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film; and a plurality of patches of electrically conductive material adhering to the dielectric film and electrically isolated from one another, wherein the electrically conductive material exhibits a nonmetallic finish as viewed by an installer of the communication cable, wherein the electrically conductive material of the tape comprises metal, and wherein the tape comprises a colorant obscuring a metallic finish of the metal.

2. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film; and a plurality of patches of electrically conductive material adhering to the dielectric film and electrically isolated from one another, wherein the electrically conductive material exhibits a nonmetallic finish as viewed by an installer of the communication cable, and wherein the strip of dielectric film comprises a colorant operable to distinguish the tape from an electrically continuous tape.

3. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film; and a plurality of patches of electrically conductive material adhering to the dielectric film and electrically isolated from one another, wherein the electrically conductive material exhibits a nonmetallic finish as viewed by an installer of the communication cable, wherein the strip of dielectric film and the plurality of patches of electrical conductive material have sufficient pliability for storing in a roll format, wherein the tape comprises a notification about grounding the tape, and wherein the nonmetallic finish comprises a substantially non-reflective finish.

4. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film; and a plurality of patches of electrically conductive material adhering to the dielectric film and electrically isolated from one another, wherein the electrically conductive material exhibits a nonmetallic finish as viewed by an installer of the communication cable, and wherein the tape comprises a plurality of grounding indicators.

5. The communication cable of claim 4, wherein the grounding indicators comprise text.

6. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film;

a plurality of patches of electrically conductive material adhering to the dielectric film and electrically isolated from one another; and another strip of dielectric film, wherein the plurality of patches of electrically conductive material are sandwiched between the strip of dielectric film and the another strip of dielectric film, wherein the electrically conductive material exhibits a nonmetallic finish as viewed by an installer of the communication cable, wherein at least one of the strip of dielectric film and the another strip of dielectric film is substantially opaque.

7. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film, a plurality of patches of electrically conductive material adhering to the dielectric film and electrically isolated from one another; and another strip of dielectric film, wherein the plurality of patches of electrically conductive material are sandwiched between the strip of dielectric film and the another strip of dielectric film, wherein the electrically conductive material exhibits a nonmetallic finish as viewed by an installer of the communication cable, and wherein at least one of the strip of dielectric film and the another strip of dielectric film is substantially colored.

8. A communication cable comprising:

a jacket defining a core extending along the communication cable; and a plurality of pairs of wires, operative to conduct communication signals, disposed in the core; and a tape circumferentially covering at least one of the plurality of pairs of wires, the tape comprising:

a strip of dielectric film;

a plurality of patches of electrically conductive material adhering to the dielectric film and electrically isolated from one another; and another strip of dielectric film, wherein the plurality of patches of electrically conductive material are sandwiched between the strip of dielectric film and the another strip of dielectric film, wherein the electrically conductive material exhibits a nonmetallic finish as viewed by an installer of the communication cable, and wherein each of the strip of dielectric film and the another strip of dielectric film substantially obscures a metallic finish of the plurality of patches.

9. A communication cable comprising:

at least one electrical conductor, extending along the communication cable, that is operable to transmit a communication signal; and a shield, extending substantially adjacent the at least one electrical conductor and comprising:

metal that is operable to shield the electrical conductor from interference; and a substantially nonmetallic appearance that is operable to avoid grounding the shield during installation of the communication cable, wherein the shield comprises a slender strip of material that is colored to obscure the metal.

10. A communication cable comprising:

at least one electrical conductor, extending along the communication cable, that is operable to transmit a communication signal; and a shield, extending substantially adjacent the at least one electrical conductor and comprising:

metal that is operable to shield the electrical conductor from interference; and a substantially nonmetallic appearance that is operable to avoid grounding the shield during installation of the communication cable, wherein the shield comprises opaque plastic, and wherein the metal is substantially hidden by the opaque plastic.

11. A communication cable comprising:

at least one electrical conductor, extending along the communication cable, that is operable to transmit a communication signal; and a shield, extending substantially adjacent the at least one electrical conductor and comprising:

metal that is operable to shield the electrical conductor from interference; and a substantially nonmetallic appearance that is operable to avoid grounding the shield during installation of the communication cable, wherein the shield comprises electrically isolated patches of the metal, and a message informing a user about grounding the shield.

12. A communication cable comprising:

a plurality of individually insulated electrical conductors, for transmitting communication signals between a first end and a second end of the communication cable; and an outer jacket covering the plurality of individually insulated electrical conductors and a tape that extends between the first end and the second end of the communication cable, wherein the tape comprises:

patches, comprising electrically conductive material, that are operable to shield at least one of the plurality of individually insulated electrical conductors from interference, wherein a patch at the first end of the communication cable is electrically isolated from a patch at the second end of the communication cable; and indicia differentiating the tape from an electrically continuous tape to an installer of the communication cable.

13. The communication cable of claim 12, wherein the indicia comprises a message informing the installer that the tape should remain ungrounded.

14. The communication cable of claim 12, wherein the indicia comprises a material that is operable to obscure the electrically conductive material from the installer.

15. The communication cable of claim 12, wherein the indicia comprises a notification intended for receipt by the installer.

16. The communication cable of claim 12, wherein the tape appears substantially non-reflective as viewed by the installer.

* * * * *